US010783771B2

(12) United States Patent
Penney

(10) Patent No.: US 10,783,771 B2
(45) Date of Patent: Sep. 22, 2020

(54) SMOKE DETECTOR TESTER

(71) Applicant: Thorn Security Limited, Sunbury-on-Thames, Middlesex (GB)

(72) Inventor: Stephen Penney, Feltham (GB)

(73) Assignee: Thorn Security Limited, Sunbury-on-Thames (GB)

( * ) Notice: Subject to any disclaimer, the term of this patent is extended or adjusted under 35 U.S.C. 154(b) by 0 days.

(21) Appl. No.: 15/765,324

(22) PCT Filed: Oct. 6, 2016

(86) PCT No.: PCT/GB2016/053120
§ 371 (c)(1),
(2) Date: Apr. 2, 2018

(87) PCT Pub. No.: WO2017/060716
PCT Pub. Date: Apr. 13, 2017

(65) Prior Publication Data
US 2018/0293878 A1 Oct. 11, 2018

(30) Foreign Application Priority Data
Oct. 6, 2015 (GB) ..... 1517651.4

(51) Int. Cl.
*G08B 29/14* (2006.01)
*B05B 17/00* (2006.01)
*G08B 17/10* (2006.01)

(52) U.S. Cl.
CPC ..... *G08B 29/145* (2013.01); *B05B 17/0646* (2013.01); *G08B 17/10* (2013.01)

(58) Field of Classification Search
None
See application file for complete search history.

(56) References Cited

U.S. PATENT DOCUMENTS 3,693,401 A * 9/1972 Purt ..... B65D 83/28 73/1.05
4,301,674 A * 11/1981 Haines ..... G08B 29/145 222/4

(Continued)

FOREIGN PATENT DOCUMENTS

CN 101965302 A 2/2011
CN 104 117 461 A 10/2014

(Continued)

OTHER PUBLICATIONS

International Preliminary Report on Patentability, dated Apr. 19, 2018, from International Application No. PCT/GB2016/053120, filed on Oct. 6, 2016. 21 pages.

(Continued)

*Primary Examiner* — Curtis J King
(74) *Attorney, Agent, or Firm* — HoustonHogle LLP

(57) ABSTRACT

The present invention relates to a fire detector testing device for installation with, or retrofitting to, a fire detector. An aerosol generator in fluid connection with a liquid reservoir directs an aerosol towards a detector element of the fire detector in order to test whether smoke entry has been compromised. The liquid reservoir of the present invention may be installed within a base of the detector, between the base and the detector, or in the detector itself.

26 Claims, 3 Drawing Sheets

(56) References Cited

U.S. PATENT DOCUMENTS 4,543,815 A * 10/1985 Troup ..... G01N 21/534 340/628
5,139,699 A * 8/1992 Cooper ..... C09K 3/30 116/214
5,170,148 A 12/1992 Duggan et al.
5,309,148 A * 5/1994 Birk ..... G08B 29/145 340/628
5,361,623 A * 11/1994 Wantz ..... B65D 83/30 73/1.05
5,596,314 A * 1/1997 Goldstein ..... G08B 17/103 340/628
5,617,079 A * 4/1997 Harrison ..... G08B 17/00 340/628
5,785,891 A * 7/1998 Lim ..... G08B 29/145 252/408.1
5,865,350 A * 2/1999 Losenno ..... B65D 83/62 222/105
6,423,962 B1 7/2002 Pepper
6,730,432 B1 * 5/2004 Grosfeld ..... H01M 2/1066 206/703
6,953,260 B1 * 10/2005 Allen ..... F21L 4/027 362/194
7,388,350 B1 * 6/2008 Wright ..... G08C 17/02 320/107
8,004,416 B2 * 8/2011 Bradley, Jr. ..... G08B 17/113 340/628
8,205,478 B1 * 6/2012 Hallisey ..... G08B 29/145 340/515
8,910,820 B2 * 12/2014 Sharpe ..... G08B 17/10 220/481
2002/0011247 A1 * 1/2002 Ivri ..... A61M 15/0028 128/200.16
2002/0021224 A1 * 2/2002 Schneider ..... G08B 29/145 340/628
2003/0136400 A1 * 7/2003 Klimowicz ..... A61M 15/00 128/200.16
2003/0227389 A1 * 12/2003 McGreal ..... G08B 17/10 340/628
2004/0004133 A1 * 1/2004 Ivri ..... A61M 11/005 239/4
2004/0035179 A1 * 2/2004 Koch ..... G01N 33/007 73/1.05
2004/0112114 A1 * 6/2004 Penney ..... G08B 29/145 73/1.01
2004/0256487 A1 * 12/2004 Collins, Jr. ..... A61M 11/005 239/338
2005/0204799 A1 * 9/2005 Koch ..... G01N 33/007 73/1.06
2006/0162502 A1 * 7/2006 Huang ..... B25B 9/00 81/53.12
2006/0255174 A1 * 11/2006 Ivri ..... B05B 17/0646 239/102.2
2007/0103330 A1 * 5/2007 McGrath ..... G08B 17/10 340/693.1
2007/0186618 A1 * 8/2007 Ackerman ..... B65D 83/20 73/1.06
2008/0018484 A1 * 1/2008 Sager ..... G08B 17/10 340/628
2008/0224847 A1 * 9/2008 Pepper ..... G08B 29/145 340/514
2008/0314602 A1 * 12/2008 Lohnes ..... A62C 13/70 169/56
2009/0025714 A1 * 1/2009 Denyer ..... A61M 15/00 128/200.23
2009/0078065 A1 * 3/2009 Rossiter ..... G08B 29/145 73/865.6
2009/0114737 A1 * 5/2009 Yu ..... A61M 11/005 239/69
2009/0212133 A1 * 8/2009 Collins, Jr. ..... A61M 11/005 239/338
2009/0237260 A1 * 9/2009 Bradley, Jr. ..... G08B 17/10 340/628
2010/0013647 A1 * 1/2010 Morris ..... H01M 10/44 340/628
2011/0108025 A1 * 5/2011 Fink ..... A61M 11/005 128/200.16
2011/0162642 A1 * 7/2011 Akouka ..... A61M 15/0045 128/200.23
2012/0263979 A1 * 10/2012 Jensen ..... H01M 2/105 429/50
2013/0111970 A1 * 5/2013 Johnsen ..... G01N 33/007 73/1.06
2013/0269684 A1 * 10/2013 Patton ..... A61M 15/0085 128/200.16
2015/0064049 A1 * 3/2015 Boswell ..... B22F 3/1241 419/49
2015/0310732 A1 * 10/2015 Piccolo, III ..... G08B 29/145 340/515
2016/0323118 A1 * 11/2016 DiPoala ..... H04L 12/2827
2016/0328936 A1 * 11/2016 Fischer ..... G08B 17/107
2016/0361506 A1 * 12/2016 Lin ..... A61M 11/005
2016/0372939 A1 * 12/2016 Roehm ..... B25F 5/00
2017/0232211 A1 * 8/2017 Gallem ..... A61M 15/0065 128/203.12
2018/0312255 A1 * 11/2018 Illuminati ..... B64C 39/024

FOREIGN PATENT DOCUMENTS

DE 102005060748 B3 3/2007
DE 10 2010 031139 A1 1/2012
DE 102012215212 A1 3/2014
EP 1580706 A1 9/2005
GB 1 305 125 1/1973
GB 2 388 062 A 11/2003
GB 2 409 319 A 6/2005
GB 2458128 A 9/2009
GB 2459322 A 10/2009
JP 2013127765 A 6/2013
WO 2006064190 A1 6/2006

OTHER PUBLICATIONS

Anand, S., et al., "Optical Manipulation of Aerosols Using Surface Acoustic Wave Nebulisation," Optical Trapping and Optical Micromanipulation VIII, 8097(1): 1-10 (2011).

Ghazanfari, T., et al., "The Influence of Fluid Physicochemical Properties on Vibrating-Mesh Nebulization," International Journal of Pharmaceutics, 339 (1-2): 103-111 (2007).

International Search Report and Written Opinion of the International Searching Authority, dated Dec. 19, 2016, from International Application No. PCT/GB2016/053120, filed on Oct. 6, 2016. 26 pages.

Search Report, dated Mar. 23, 2016, from GB Application No. 1517651.4, filed on Oct. 6, 2015. 7 pages.

Tsai, C., et al., "Ultrasound-Driven Megahertz Faraday Waves for Generation of Monodisperse Micro Droplets and Applications," Physics Procedia, 70: 872-875 (2015).

* cited by examiner

SMOKE DETECTOR TESTER

RELATED APPLICATIONS

This application is a § 371 National Phase Application of International Application No. PCT/GB2016/053120, filed on Oct. 6, 2016, now International Publication No. WO 2017/060716 A1, published on Apr. 13, 2017, which International Application claims priority to GB Application 1517651.4, filed on Oct. 6, 2015, both of which are incorporated herein by reference in their entirety.

The present invention relates to a smoke detector tester for use in testing smoke detectors in fire alarm systems, and to a method of testing smoke detectors.

Smoke detectors are often sited where it is difficult or inconvenient to use conventional methods to test them. For example, the area in which a smoke detector is placed might have restricted access (such as some research or military establishments), or testing of a smoke detector might be disruptive (such as in a continuously occupied hospital ward), or the detector might be in a location which is hazardous to human health (such as certain areas of a nuclear power station), or the smoke detector might be located in a position which is accessible only with special equipment such as ladders, scaffolding or lifts. In such circumstances, smoke detectors might not be tested as frequently as they should, or the cost of testing is very high.

Many modern smoke detectors currently have the capability of monitoring both electrical and operational aspects of their performance automatically The only parameter of operation which isn't automatically tested is whether entry of smoke has been compromised, for example by the build-up of dirt on the air inlet leading to a detector element within the smoke detector. To check this parameter, a test needs to establish the ability for smoke to reach the detector element of the smoke detector.

Known detector testers mount smoke simulators on the end of long poles, such as those disclosed in CN 101965302 B, U.S. Pat. No. 6,423,962 B1 and U.S. Pat. No. 5,170,148 A. Such detector testers include a hood at one end of the pole which fits over the body of a detector, and an aerosol can containing a paraffin-based liquid which is released into the hood as an aerosol spray to simulate the presence of smoke particles. These detector testers overcome some of the issues regarding difficult to reach detectors (e.g. detectors mounted on high ceilings), however, they fail to overcome the difficulty of testing detectors in many of the inconvenient places described above. Paraffin is used because an aerosol containing it is relatively stable compared with aerosols of other liquids, and paraffin based aerosols have a high persistence, suitable particle size, refractive index and particle mass. Water is not used because it doesn't form a suitable aerosol for detector testing as the particle mass is too high relative to smoke particles and its behaviour is very different.

One known tester which seeks to solve these problems is mounted beside a pre-installed detector. The tester includes a support rail which is attached to the detector that is to be tested or to the base on which the detector is mounted, a body which contains an aerosol can, and a tube leading from the body to a nozzle head from which an aerosol spray generated by the tester is directed towards the detection chamber of the smoke detector. This known tester uses its own independent power and data cables and test control panel, separate from any pre-installed fire alarm system cabling and fire system control panel. Up to 8 tester units may be connected by the cabling to a single test control panel. The test control panel may be located up to a maximum of 100 metres away from a unit, depending on the type of cable used. To carry out a test of a fire detector, an engineer attends the site of the fire alarm system, and moves the system from its active state into a test mode. To test the detector or detectors, he introduces a power source to the control panel. The control panel then causes the tester unit or units to conduct its tests by releasing an aerosol spray from the aerosol can directed at the fire detector. Each fire detector will indicate when it has detected the aerosol. If a fire detector does not detect the aerosol, the engineer will investigate further and rectify any problem. Once complete, the engineer will remove the power source and return the fire alarm system to its active state. Each tester unit remains in an inert state when not in use.

This tester has several disadvantages which can make it impractical to implement. Firstly, we have found that the tester must be kept horizontal in order to operate properly. Secondly, the location of the centre of mass of the tester well away from the centre of the smoke detector can exert an unnecessary strain on the detector to which it is mounted. Thirdly, the orientation of the tester affects the effectiveness of the tests that are carried out. The tester might only fit into position along a certain axis (e.g. along a corridor), but the air flow in that location might oppose the passage of the aerosol to the detector element, reducing the reliability of any test. Fourthly, this tester requires the supply of a relatively large amount of power during operation to generate the aerosol, making it relatively expensive to install with its own control & power cabling. Finally, this tester uses a paraffin based aerosol due to the more stable aerosol that is produced. However, paraffin can leave a residue on a detector, which is undesirable.

DE102012215212 discloses a fire detector which could be tested by the introduction of an externally generated aerosol which is an integral part of the fire detector. It generates a test aerosol by vaporisation or by nebulisation of a test liquid using a high pressure air jet impinging on a liquid in a way that causes that liquid to form an aerosol. It describes soot particles which are aerosolised by condensing water droplets onto them, this is presumably to ensure that the test species have the fire specific particle size required for the detector test, although there is no disclosure of how this might be accomplished.

The present invention aims to overcome at least some of the above problems.

According to a first aspect of the invention, a fire detector testing device comprises: a liquid reservoir; and a vibrating mesh type aerosol generator in fluid connection with the liquid reservoir for generating an aerosol of a liquid from the liquid reservoir, arranged such that, when generated, the aerosol is directed towards a detector element of a fire detector.

In this specification, the term "vibrating mesh" is used to describe the type of aerosol generator that is used in this application, and includes both the type of generator where, in use, the mesh itself is vibrated to generate an aerosol and the type of generator where, in use, the mesh is fixed and a vibrating driver element is used to cause a liquid to be aerosolised as it passes through the mesh.

The use of the vibrating mesh overcomes or reduces at least some of the disadvantages of the known tester listed above. Additionally, the vibrating mesh mechanism, by its nature generates specific particle sizes without the inclusion of any solid particulates. The fact that DE102012215212 discloses the delivery of soot particles in the aerosol forces the use of a nebulising system which permits the soot to be atomised, in this case, a pneumatic one. Consequentially, the use of a vibrating mesh nebuliser would not have been appropriate. Furthermore, the need to use a paraffin based liquid for atomisation in order to obtain a stable aerosol would cause the skilled person to disregard any thoughts that a vibrating mesh system would be appropriate because the paraffin would be expected to clog the holes in the mesh and have a viscosity that is too high to permit atomisation.

The testing device may advantageously be installed alongside a new fire alarm system or retrofitted. The vibrating mesh type aerosol generator has the great advantages of being both directional and requiring low power. This makes it effective in directing an aerosol towards a detector element of a fire detector, it allows the device to be made more cheaply and using more compact components because of the lower operating power, and opens up the possibility of powering the device from the cabling of a fire alarm system, instead of requiring independent cabling.

It is preferred that the liquid reservoir of the fire detector testing device is deformable. As such, the reservoir requires no venting, reducing liquid loss through processes other than aerosol generator, for example, evaporation, leakage or capillary action, and reducing the likelihood of the liquid becoming contaminated.

In the preferred embodiments, a tube extends from the liquid reservoir to the vibrating mesh type aerosol generator. Advantageously, the reservoir and the tube support the aerosol generator relative to a fire detector such that, when generated, the aerosol is directed towards a detector element of the fire detector. This reduces or removes the need for extra support for the aerosol generator, reducing device complexity and cost.

In another embodiment, the liquid reservoir and the aerosol generator are adjacent, in that the aerosol generator is next to or adjoins the liquid reservoir. In this embodiment, a tube can be arranged to deliver the aerosol from the aerosol generator and direct it towards a detector element of the fire detector. This reduces the likelihood of the aerosol generator becoming damaged.

The fire detector testing device may further comprise an interface device disposed between the fire detector testing device and the fire detector for activating the testing device. This allows the testing of the fire detector to be initiated remotely, and perhaps even automatically. Initiation of a test might typically be controlled from the control panel, or even from a completely separate site. Remote activation provides simplicity in testing detectors in inconvenient or hazardous locations, and testing at lower cost by initiating the test remotely, either from the control panel or from an off-site location, and self-testing by initiating the test automatically from the detector, from the testing device, or remotely. One of the things which makes it possible, in practice, to remotely operate the testing device is the isolation of each detector being tested in turn while the rest of the system remains active. This might be achieved by an operator going to the control panel and instructing it to carry out a test of the detectors, at which point, the control panel would isolate each detector in turn, perform the test, then de-isolate the detector. Alternatively, the control panel is given a standing instruction to test detectors on a regular basis, and this can be done automatically with no operator involvement.

The liquid in the liquid reservoir may be water with an ionic content, such as a very dilute acid solution. Advantageously, the liquid should not leave a residue on the smoke detector. A very dilute acid solution will aid in preventing static build up on the mesh of the aerosol generator.

The fire detector testing device may further comprise a power storage device, such that the device may be activated even in situations where its normal power supply does not provide enough power.

According to a second aspect of the invention, a self-test fire detector comprises: a smoke detector having a detector element; and a fire detector testing device which includes a liquid reservoir and an aerosol generator, in fluid connection with the liquid reservoir, for generating an aerosol of a liquid from the liquid reservoir, positioned such that, when generated, the aerosol is directed towards the detector element of the smoke detector; wherein the liquid reservoir is at least partially located within the smoke detector.

Locating the liquid reservoir within the smoke detector has the advantage of reducing the footprint of the self-test fire detector. The smaller footprint means that the self-test detector can be located and oriented in areas and positions in which it would have been difficult to place a separate detector and tester combination. Further, locating the liquid reservoir within the detector reduces support requirements and reduces the likelihood of the tester sustaining damage from external sources.

The self-test fire detector might further include a base, in which case, the liquid reservoir can be located in the base. Alternatively, the liquid reservoir can be located between the base and the detector.

The base portion can also rotate relative to the detector in some arrangements. In detector locations where airflow is unknown, or may change, it is advantageous to be able to reposition the aerosol generator such that it remains effective.

As with the first aspect, the liquid reservoir of the self-test fire detector can be deformable to remove the need for venting.

In the preferred embodiments, a tube extends from the liquid reservoir to the vibrating mesh type aerosol generator. Advantageously, the reservoir and the tube support the aerosol generator relative to a fire detector such that, when generated, the aerosol is directed towards a detector element of the fire detector. This reduces or removes the need for extra support for the aerosol generator, reducing device complexity and cost.

In another embodiment, the liquid reservoir and the aerosol generator are adjacent, in that the aerosol generator is next to or adjoins the liquid reservoir. In this embodiment, a tube can be arranged to deliver the aerosol from the aerosol generator and direct it towards a detector element of the fire detector. This reduces the likelihood of the aerosol generator becoming damaged.

The fire detector testing device may further comprise an interface device disposed between the fire detector testing device and the fire detector for activating the testing device. This allows the testing of the fire detector to be initiated remotely, and perhaps even automatically. Initiation of a test might typically be controlled from the control panel, or even from a completely separate site. Remote activation provides simplicity in testing detectors in inconvenient or hazardous locations, and testing at lower cost by initiating the test remotely, either from the control panel or from an off-site location, and self-testing by initiating the test automatically from the detector, from the testing device, or remotely. One of the things which makes it possible, in practice, to remotely operate the testing device is the isolation of each detector being tested in turn while the rest of the system remains active. This might be achieved by an operator going to the control panel and instructing it to carry out a test of the detectors, at which point, the control panel would isolate each detector in turn, perform the test, then de-isolate the detector. Alternatively, the control panel is given a standing instruction to test detectors on a regular basis, and this can be done automatically with no operator involvement.

The liquid in the liquid reservoir is water with an ionic content, such as a weak acid. Advantageously, the water should not leave a residue on the smoke detector. This will aid in preventing static build up on the mesh of the aerosol generator.

The fire detector testing device may further comprise a power storage device, such that the device may be activated even in situations where its normal power supply does not provide enough power.

According to a third aspect of the invention, a fire detector testing device, comprises: a liquid reservoir; an aerosol generator, in fluid connection with the liquid reservoir, arranged such that, when generated, the aerosol is directed towards a detector element of the fire detector; and a power connector for electrically connecting the testing device to the supply of electrical power for the fire detector.

The third embodiment has the advantage that a fire detector testing device would not require extra cabling to be implemented to provide power to the tester. This reduces one of the major costs incurred when installing this kind of detector testing system.

As with the first aspect, the liquid reservoir of the fire detector testing device may be deformable, removing the need for venting.

In the preferred embodiments, a tube extends from the liquid reservoir to the vibrating mesh type aerosol generator. Advantageously, the reservoir and the tube support the aerosol generator relative to a fire detector such that, when generated, the aerosol is directed towards a detector element of the fire detector. This removes or reduces the need for extra support for the aerosol generator, reducing device complexity and cost.

In another embodiment, the liquid reservoir and the aerosol generator are adjacent, in that the aerosol generator is next to or adjoins the liquid reservoir. In this embodiment, a tube can be arranged to deliver the aerosol from the aerosol generator and direct it towards a detector element of the fire detector. This reduces the likelihood of the aerosol generator becoming damaged.

The fire detector testing device may further comprise an interface device disposed between the fire detector testing device and the fire detector for activating the testing device. This allows the testing of the fire detector to be initiated remotely, and perhaps even automatically. Initiation of a test might typically be controlled from the control panel, or even from a completely separate site. Remote activation provides simplicity in testing detectors in inconvenient or hazardous locations, and testing at lower cost by initiating the test remotely, either from the control panel or from an off-site location, and self-testing by initiating the test automatically from the detector, from the testing device, or remotely. One of the things which makes it possible, in practice, to remotely operate the testing device is the isolation of each detector being tested in turn while the rest of the system remains active. This might be achieved by an operator going to the control panel and instructing it to carry out a test of the detectors, at which point, the control panel would isolate each detector in turn, perform the test, then de-isolate the detector. Alternatively, the control panel is given a standing instruction to test detectors on a regular basis, and this can be done automatically with no operator involvement.

The liquid in the liquid reservoir is water with an ionic content, such as a weak acid. Advantageously, the liquid should not leave a residue on the fire detector. Ionic water will aid in preventing static build up on the mesh of the aerosol generator.

The fire detector testing device may further comprise a power storage device, such that the device may be activated even in situations where its normal power supply does not provide enough power.

Embodiments of the invention are described below by way of example, and with reference to the accompanying drawings in which.

Figure 1:
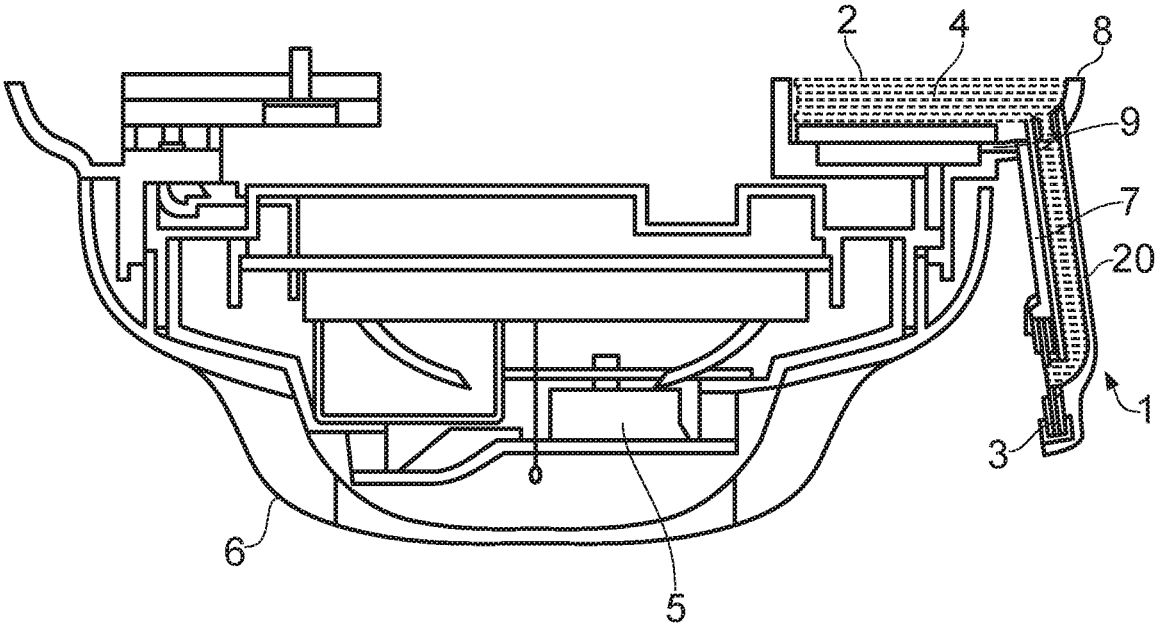
FIG. 1 is a sectional view of a fire detector and fire detector testing device according to a first embodiment of the invention.
Figure 2:
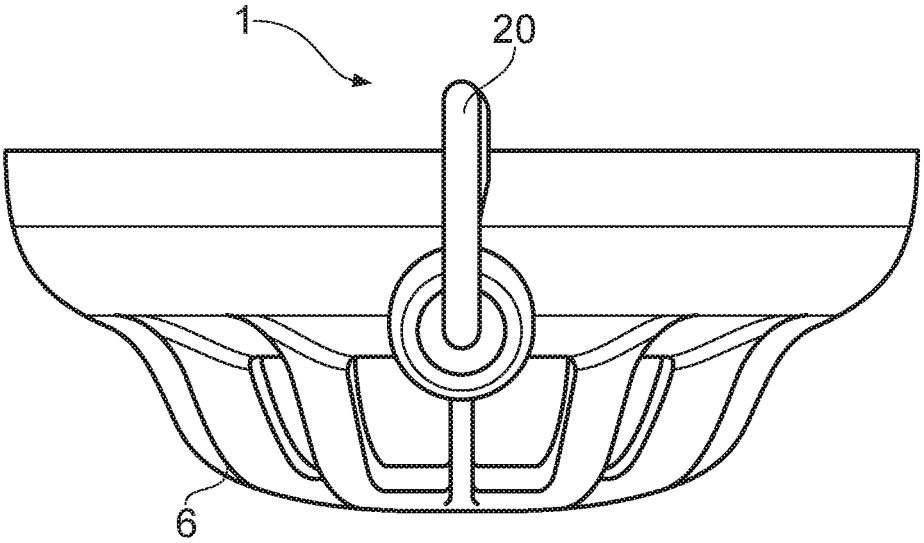
FIG. 2 is a side view of the fire detector and fire detector testing device of the first embodiment.

FIG. 1 shows a first embodiment of the present invention in which a fire detector 6 is attached to a detector base 8 and a fire detector testing device 1 is mounted partially within the base to which the fire detector 6 is mounted. In this case, the fire detector 6 is a smoke detector having a detector element 5 located within the body of the fire detector. The body of the fire detector includes openings through which airborne smoke particles are able to pass which lead to the detector element 5. The detector element 5 might, for example, be an optical smoke detector element. The openings through which the airborne smoke particles are able to pass often include grills to impede the entry of insects or large airborne particles which do not originate from a fire. In very dirty environments, the grills can become blocked with dirt, obstructing the entry of smoke particles, thereby limiting the performance of the smoke detector.

The detector base 8 is attached to the surface of a building, typically a ceiling or wall, and is connected to a fire alarm system via alarm cabling which is typically arranged in a loop, each loop ending at a control panel (known in Europe as 'control and indicating equipment', or CIE). The loop will normally connect a number of components of a fire alarm system, such as detectors, sounders, alarm buttons and the like. The loop will also provide electrical power to the components. Attachment of the fire detector 6 to the base plate connects the fire detector 6 directly to the alarm cabling loop.

The fire detector testing device 1 includes a liquid reservoir 2 containing a liquid 4 to be aerosolised, a wire 7, a tube 20 leading the liquid 4 from the liquid reservoir 2, and an aerosol generator 3 carried at an end of the tube 20 and connected to the end of the wire 7. While the liquid reservoir 2 is located within the base 8, the tube 20 extends out from the base 8 and around the outside of the fire detector 6 to the aerosol generator 3 which is located outside of the fire detector 6 facing the openings into the fire detector 6 through which smoke would pass on its way to the detector element 5. The aerosol generator 3 is held in position by a combination of the liquid reservoir 2, and the tube 20, which extends outwardly from the base so that the aerosol generator 3 faces the detector element 5. The aerosol generator 3 is a vibrating mesh type aerosol generator in which the mesh is supported by piezoelectric elements which can be caused to vibrate, thereby releasing the liquid located immediately behind the mesh through the holes in the mesh and forming an aerosol. The characteristics of the aerosol, such as the amount of liquid which is aerosolised and the droplet size are a function of the size of the holes in the mesh and the characteristics of the vibrations applied to the mesh by the piezoelectric crystal element. The aerosol generator 3 is a low-power device in that it is able to atomise the liquid without drawing much power from the fire alarm system cabling. This is important because the fire alarm cabling is very limited in the amount of power that it can supply.

In this embodiment, the reservoir is located within the base, and is shaped to fit into a suitable space within that base. The reservoir 2 is made of a deformable structure so that it will yield. In this embodiment, this is effected simply by the side walls of the reservoir 2 being deformable and flexible, but in other embodiments it could be effected by a bellows like structure which collapses as the volume of liquid 4 reduces. This ensures that, as liquid is atomised, it is not replaced by ambient air which might contaminate the liquid with within the reservoir.

The detector 6 includes a data interface which connects the detector to the fire alarm cabling so that it is able to communicate with a control panel while maintaining a supply of power to the detector element 5. The data interface is also connected to the fire detector testing device 1. The data interface comprises a printed circuit board (9) and might include an antenna (not shown) for receipt of wireless signals.

A power storage device (not shown) may be incorporated into the testing device 1. Should the instantaneous power supplied by the alarm cabling not be enough to drive the aerosol generator 3, the aerosol generator 3 draws power from the power storage device. At other times, the power storage device is charged from the alarm cabling, and might be in the form of a rechargeable battery or supercapacitor.

There are two different ways in which a test might be instigated. The first is automatic where the detector or the testing device or the control panel automatically instigates a self-test of some or all of the detectors. The second is a manually instigated test in which a person causes the control panel to place the detector into a test mode before a test is carried out. That person might instigate the test at the individual detector to be tested, from the control panel, or from a remote location such as a monitoring station. In either case, the fire detector 6 and the fire detector testing device 1 are caused to carry out a test upon receipt of a test signal by the data interface, which might be received from the control panel via the fire alarm cabling or wirelessly if the test signal is a wireless signal.

When a test is carried out, the detector 6 is placed in a test mode so that, if it detects a fire condition during the test, it does not cause a fire alarm signal to be sent to any sounders or other alarm notification devices. The fire detector testing device 1 then generates an aerosol from the aerosol generator 3. This is done by applying an AC signal to the aerosol generator via the wire 7 in order to cause the mesh to be vibrated. The piezoelectric elements cause the mesh to be vibrated and droplets of the liquid are forced through the mesh in the form of an aerosol which is directed towards the detector element 5 of the fire detector 6. As the liquid 4 is aerosolised, the liquid reservoir collapses as it is emptied. The aerosol has smoke-like properties which cause the detector element 5 to generate an alarm signal. If the detector element 5 does not generate an alarm signal because it has not received the droplets, a notification is generated which is sent to a service engineer who can investigate the reasons why the detector element 5 did not generate an alarm signal. This might simply be because the grill across the opening to the detector element 5 has become clogged with dirt. The grill can be cleaned, and the detector reinstalled. Once the test is complete, the fire detector 6 is returned to its normal operating condition from the test mode.

When the detector 6 is activated, power from the alarm cabling is used to generate a 640 kHz 17.5V (peak to peak) signal with a 128 kHz 10V (peak to peak) signal superimposed to power the aerosol generator 3. The current draw is roughly 100 mA. This current draw is quite large compared to the detector, however, in the preferred embodiment, only one detector should be tested at a time as it is undesirable to isolate an entire system for testing at once. Further power may be supplied from the power storage device, where included.

The AC signal causes the mesh in the nebuliser to vibrate, which forces out microscopic droplets.

The liquid 4 in the liquid reservoir 2 is a weak acid, although other types of water with an ionic content can be used. Aerosolised water behaves similarly enough to smoke to cause the detector 6 to go into alarm. The use of a weak acid prevents a static build up on the mesh of the nebuliser. Preferably the water contains a substance to resist bacterial growth, or is sterilised prior to being placed in the liquid reservoir 2.

Figure 3:
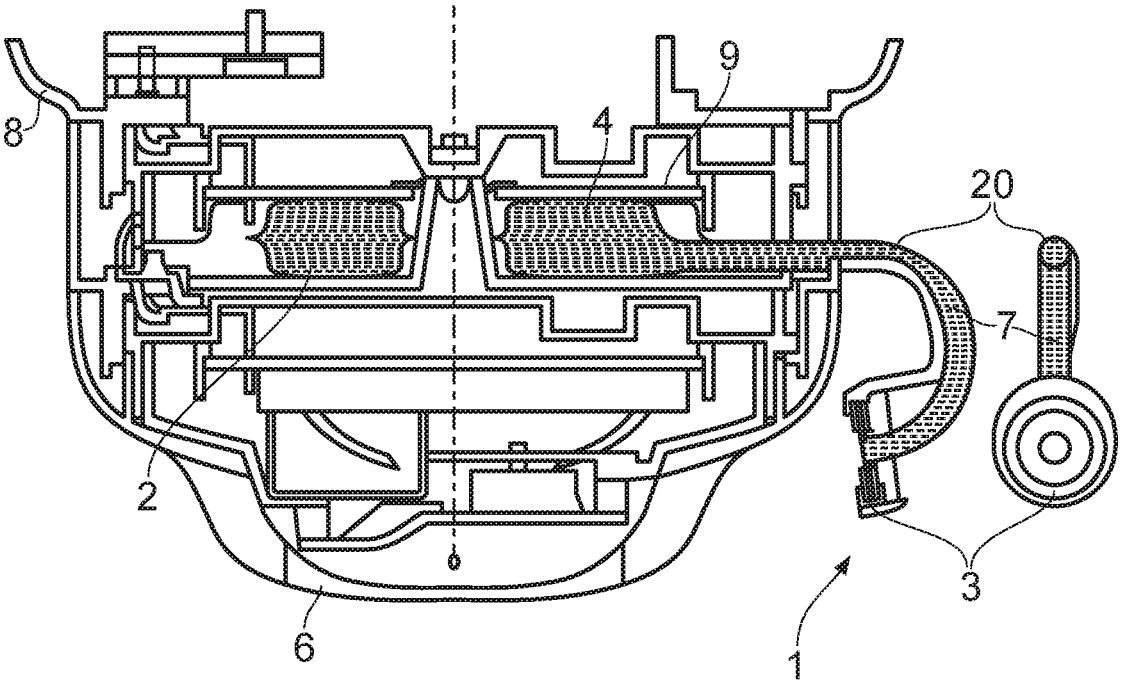
FIG. 3 is a sectional view of a fire detector and fire detector testing device according to a second embodiment of the invention.

FIG. 3 shows a second embodiment of the present invention in which a fire detector 6 is attached to a detector base 8 and a fire detector testing device 1 is mounted partially between the base 8 and the fire detector 6. In this case, the fire detector 6 is a smoke detector having a detector element 5 located within the body of the fire detector. The body of the fire detector includes openings through which airborne smoke particles are able to pass which lead to the detector element 5. The detector element 5 might, for example, be an optical smoke detector element. The openings through which the airborne smoke particles are able to pass often include grills to impede the entry of insects or large airborne particles which do not originate from a fire. In very dirty environments, the grills can become blocked with dirt, obstructing the entry of smoke particles, thereby limiting the performance of the smoke detector.

The detector base 8 is attached to the surface of a building, typically a ceiling or wall, and is connected to a fire alarm system via alarm cabling which is typically arranged in a loop, each loop ending at a control panel. The loop will normally connect a number of components of a fire alarm system, such as detectors, sounders, alarm buttons and the like. The loop will also provide electrical power to the components. Attachment of the fire detector 6 to the base plate connects the fire detector 6 directly to the alarm cabling loop.

The fire detector testing device 1 includes a liquid reservoir 2 containing a liquid 4 to be aerosolised, a wire 7, a tube 20 leading the liquid 4 from the liquid reservoir 2, and an aerosol generator 3 carried at an end of the tube 20 and connected to the end of the wire 7. While the liquid reservoir 2 is located between the base 8 and the fire detector 6, the tube 20 extends out from between them and around the outside of the fire detector 6 to the aerosol generator 3 which is located outside of the fire detector 6 facing the openings into the fire detector 6 through which smoke would pass on its way to the detector element 5. The aerosol generator 3 is held in position by a combination of the liquid reservoir 2 and the tube 20, which extends outwardly from between the base and the fire detector so that the aerosol generator 3 faces the detector element 5. The aerosol generator 3 is a vibrating mesh type aerosol generator in which the mesh is supported by piezoelectric elements which can be caused to vibrate, thereby releasing the liquid located immediately behind the mesh through the holes in the mesh and forming an aerosol. The characteristics of the aerosol, such as the amount of liquid which is aerosolised and the droplet size are a function of the size of the holes in the mesh and the characteristics of the vibrations applied to the mesh by the piezoelectric crystal element. The aerosol generator 3 is a low-power device in that it is able to atomise the liquid without drawing much power from the fire alarm system cabling. This is important because the fire alarm cabling is very limited in the amount of power that it can supply.

In this embodiment, the reservoir is located between the base and the fire detector 6, and is shaped to fit into a suitable space. The reservoir 2 is made of a deformable structure so that it will yield. In this embodiment, this is effected simply by the side walls of the reservoir 2 being deformable and flexible, but in other embodiments it could be effected by a bellows like structure which collapses as the volume of liquid 4 reduces. This also ensures that, as liquid is atomised, it is not replaced by ambient air which might contaminate the liquid with within the reservoir.

The detector 6 includes a data interface which connects the detector to the fire alarm cabling so that it is able to communicate with a control panel while maintaining a supply of power to the detector element 5. The data interface is also connected to the fire detector testing device 1. The data interface comprises a printed circuit board (9) and might include an antenna (not shown) for receipt of wireless signals;

A power storage device (not shown) may be incorporated into the testing device 1. Should the instantaneous power supplied by the alarm cabling not be enough to drive the aerosol generator 3, the aerosol generator 3 draws power from the power storage device. At other times, the power storage device is charged from the alarm cabling, and might be in the form of a rechargeable battery or supercapacitor;

The ways in which a test may be instigated, and the testing and operation for this embodiment is the same as the first.

Figure 4:
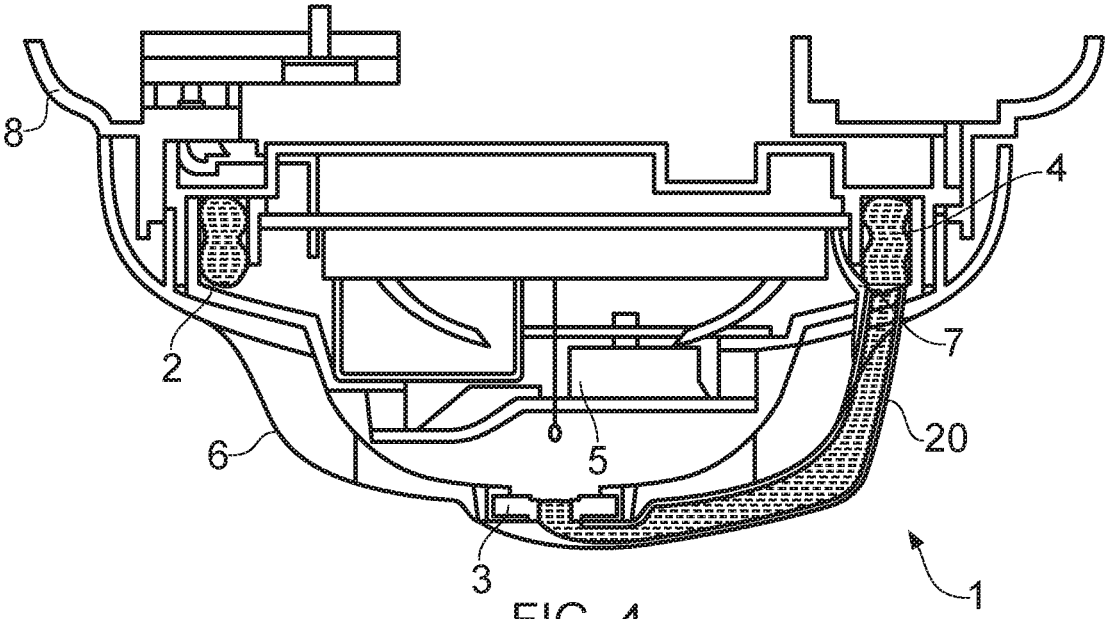
FIG. 4 is a sectional view of a fire detector and fire detector testing device according to a third embodiment of the invention.

FIG. 4 shows a third embodiment of the present invention in which a fire detector 6 is attached to a detector base 8 and a fire detector testing device 1 is mounted partially within the fire detector 6. In this case, the fire detector 6 is a smoke detector having a detector element 5 located within the body of the fire detector. The body of the fire detector includes openings through which airborne smoke particles are able to pass which lead to the detector element 5. The detector element 5 might, for example, be an optical smoke detector element. The openings through which the airborne smoke particles are able to pass often include grills to impede the entry of insects or large airborne particles which do not originate from a fire. In very dirty environments, the grills can become blocked with dirt, obstructing the entry of smoke particles, thereby limiting the performance of the smoke detector.

The fire detector 6 also includes an antenna (not shown) for receipt or transmission of wireless signals.

The detector base 8 is attached to the surface of a building, typically a ceiling or wall, and is connected to a fire alarm system via alarm cabling which is typically arranged in a loop, each loop ending at a control panel. The loop will normally connect a number of components of a fire alarm system, such as detectors, sounders, alarm buttons and the like. The loop will also provide electrical power to the components. Attachment of the fire detector 6 to the base plate connects the fire detector 6 directly to the alarm cabling loop.

The fire detector testing device 1 includes a liquid reservoir 2 containing a liquid 4 to be aerosolised, a wire 7, a tube 20 leading the liquid 4 from the liquid reservoir 2, and an aerosol generator 3 carried at an end of the tube 20 and connected to the end of the wire 7. While the liquid reservoir 2 is located within the fire detector 6, the tube 20 extends out from the fire detector 6 and around the outside of the fire detector 6 to the aerosol generator 3 which is located outside of the fire detector 6 facing the openings into the fire detector 6 through which smoke would pass on its way to the detector element 5. The aerosol generator 3 is held in position by a combination of the liquid reservoir 2, and the tube 20, which extends outwardly from the fire detector so that the aerosol generator 3 faces the detector element 5. The aerosol generator 3 is a vibrating mesh type aerosol generator in which the mesh is supported by piezoelectric elements which can be caused to vibrate, thereby releasing the liquid located immediately behind the mesh through the holes in the mesh and forming an aerosol. The characteristics of the aerosol, such as the amount of liquid which is aerosolised and the droplet size are a function of the size of the holes in the mesh and the characteristics of the vibrations applied to the mesh by the piezoelectric crystal element. The aerosol generator 3 is a low-power device in that it is able to atomise the liquid without drawing much power from the fire alarm system cabling. This is important because the fire alarm cabling is very limited in the amount of power that it can supply.

In this embodiment, the reservoir is located within the fire detector, and is shaped to fit into a suitable space within that detector. The reservoir 2 is made of a deformable structure so that it will yield. In this embodiment, this is effected simply by the side walls of the reservoir 2 being deformable and flexible, but in other embodiments it could be effected by a bellows like structure which collapses as the liquid within the liquid reservoir 2 is depleted during use. This also ensures that, as liquid is atomised, it is not replaced by ambient air which might contaminate the liquid with within the reservoir.

The detector 6 includes a data interface which connects the detector to the fire alarm cabling so that it is able to communicate with a control panel while maintaining a supply of power to the detector element 5. The data interface is also connected to the fire detector testing device 1. The data interface comprises a printed circuit board (9) and might include an antenna (not shown) for receipt of wireless signals;

A power storage device (not shown) may be incorporated into the testing device 1. Should the instantaneous power supplied by the alarm cabling not be enough to drive the aerosol generator 3, the aerosol generator 3 draws power from the power storage device. At other times, the power storage device is charged from the alarm cabling, and might be in the form of a rechargeable battery or supercapacitor.

The ways in which a test may be instigated, and the testing and operation for this embodiment is the same as the first.

Figure 5A:
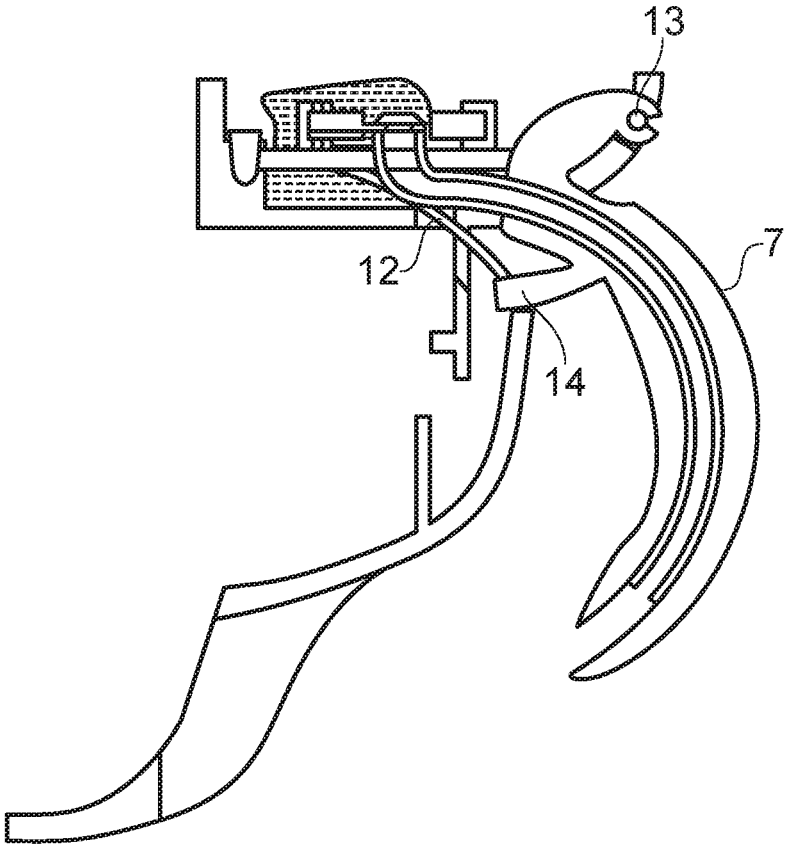
FIGS. 5*a* and 5*b* are partial sectional views of a fire detector and fire detector testing device in two positions according to a fourth embodiment of the invention.
Figure 5B:
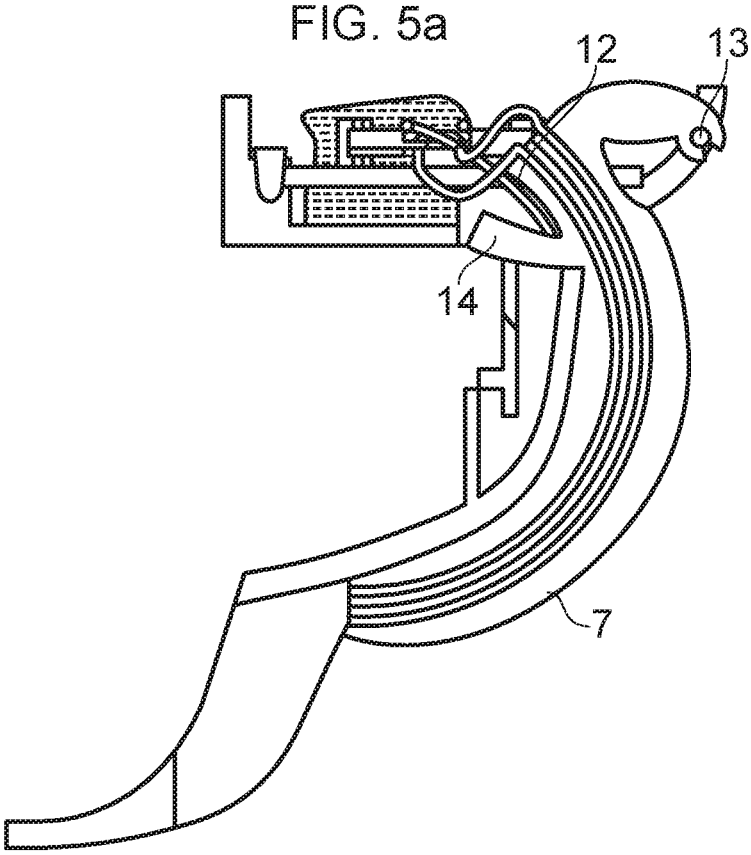

FIGS. 5*a* and 5*b* show a way of positioning the tube 20 against the casing of the detector 6, in order to increase accuracy of the aerosol generator 3. The tube 20 is mounted about a pivot point 13. In this example, the pivot point 13 is attached to the base unit. A biasing means 12 holds the tube 20 away from the detector 6 during installation of the detector, as shown in FIG. 5*a*. Upon attachment of the fire detector to the base 8, the case of the detector 6 presses against a flange 14, displacing the tube about the pivot point 13 against the bias of the biasing means 12, so that the tube is held in position against the case of the detector 6.

The embodiments described above use a vibrating mesh type aerosol generator in which the mesh itself is vibrated in order to aerosolise the liquid. In other embodiments, a different type of vibrating mesh type aerosol generator is used in which the mesh is fixed and a vibrating driver element is located behind the mesh for driving the liquid through the mesh to cause atomisation.

The embodiments described above also describe the liquid reservoir and the aerosol generator being located at differing ends of the tube. In other embodiments, the liquid reservoir and the aerosol generator may be adjacent, such that the liquid in the liquid reservoir is aerosolised and the tube directs the aerosol towards the detector element of the fire detector.

The above embodiments are based on a cabled alarm system. However, wireless embodiments are also envisaged. In such a system, it is particularly advantageous if the test device is not powered by the detector causing the detector's power supply to be more rapidly depleted.

The invention claimed is:

1. A fire detector testing device, comprising:

a liquid reservoir; and a vibrating mesh type aerosol generator, in fluid connection with the liquid reservoir, for generating an aerosol of a liquid from the liquid reservoir, arranged such that, when generated, the aerosol is directed towards a detector element of a fire detector, wherein the fire detector testing device is part of a self-test fire detector comprising the fire detector, and the liquid reservoir is positioned such that, when generated, the aerosol is directed towards the detector element of the smoke detector.

2. The fire detector testing device according to claim 1 wherein the liquid reservoir is deformable.

3. The fire detector testing device according to claim 1, further comprising a tube extending from the liquid reservoir to the aerosol generator.

4. The fire detector testing device according to claim 3, wherein the liquid reservoir and the tube support the aerosol generator.

5. The fire detector testing device according to claim 1, wherein the liquid reservoir and the aerosol generator are adjacent.

6. The fire detector testing device according to claim 5, further comprising a tube extending from the aerosol generator.

7. The fire detector testing device according to claim 1 wherein the liquid in the liquid reservoir is water with an ionic content.

8. The fire detector testing device according to claim 1 wherein the fire detector testing device further comprises a power storage device.

9. The fire detector testing device according to claim 1 wherein the vibrating mesh type aerosol generator comprises a mesh.

10. The fire detector testing device according to claim 9 wherein the mesh of the vibrating mesh type aerosol generator is caused to vibrate in order to generate the aerosol.

11. The fire detector testing device according to claim 9 wherein the mesh of the vibrating mesh type aerosol generator is fixed, and the vibrating mesh type aerosol generator comprises a vibrating driver element located behind the mesh for driving the liquid through the mesh to cause atomization.

12. The fire detector testing device according to claim 9 wherein the mesh is supported by piezoelectric elements, which are caused to vibrate, thereby releasing liquid located immediately behind the mesh through the holes in the mesh in order to generate the aerosol.

13. The fire detector testing device according to claim 9 wherein characteristics of the aerosol including amount of liquid which is aerosolized and droplet size are based on sizes of holes in the mesh and characteristics of vibrations applied to the mesh by piezoelectric crystal elements.

14. A self-test fire detector, comprising:

a smoke detector having a detector element; and a fire detector testing device which includes a liquid reservoir and an aerosol generator, in fluid connection with the liquid reservoir, for generating an aerosol of liquid from the liquid reservoir, positioned such that, when generated, the aerosol is directed towards the detector element of the smoke detector;

wherein the liquid reservoir is at least partially located within the smoke detector.

15. The self-test fire detector according to claim 14 wherein the fire detector includes a base, and the liquid reservoir is located within the base.

16. The self-test fire detector according to claim 15 wherein the fire detector includes a base, and the liquid reservoir is located between the base and the detector element.

17. The self-test fire detector according to claim 16 wherein the base portion can rotate with respect to the detector.

18. The self-test fire detector according to claim 14 wherein the liquid reservoir is deformable.

19. The self-test fire detector according to claim 14, further comprising a tube extending from the liquid reservoir to the aerosol generator.

20. The self-test fire detector according to claim 19, wherein the liquid reservoir and the tube support the aerosol generator.

21. The self-test fire detector according to claim 14, wherein the liquid reservoir and the aerosol generator are adjacent.

22. The self-test fire detector according to claim 21, further comprising a tube extending from the aerosol generator.

23. The self-test fire detector according to claim 14, further comprising a data interface device disposed between the fire detector testing device and the fire detector for activating the testing device.

24. The self-test fire detector according to claim 14 wherein the liquid in the liquid reservoir is water with an ionic content.

25. The self-test fire detector according to claim 14 wherein the fire detector testing device further comprises a power storage device.

26. The self-test fire detector according to claim 14, wherein the aerosol generator of the fire detector testing device is a vibrating mesh type aerosol generator.

* * * * *